US007351288B2

(12) United States Patent
Nguyen

(10) Patent No.: US 7,351,288 B2
(45) Date of Patent: Apr. 1, 2008

(54) SHOCK ABSORBING FLUIDIC ACTUATOR

(75) Inventor: Andrew P. Nguyen, San Jose, CA (US)

(73) Assignee: ASML Holding N.V., Velhoven (NL)

( * ) Notice: Subject to any disclaimer, the term of this patent is extended or adjusted under 35 U.S.C. 154(b) by 675 days.

(21) Appl. No.: 10/743,964

(22) Filed: Dec. 22, 2003

(65) Prior Publication Data

US 2005/0135938 A1 Jun. 23, 2005

(51) Int. Cl.

| | |
|---|---|
| ***B05B 3/00*** | (2006.01) |
| ***B05C 11/02*** | (2006.01) |
| ***F01B 31/12*** | (2006.01) |
| ***F15B 21/10*** | (2006.01) |
| ***F15B 13/16*** | (2006.01) |

(52) U.S. Cl. ..... 118/323; 118/52; 91/393; 91/1; 91/361

(58) Field of Classification Search ..... 118/323, 118/52, 612, 319–320, 300; 91/393, 1, 361, 91/363 R; 60/486, 412; 901/43
See application file for complete search history.

(56) References Cited

U.S. PATENT DOCUMENTS 4,901,625 A * 2/1990 Bussan et al. ..... 91/361
5,152,143 A * 10/1992 Kajita et al. ..... 60/420
5,431,086 A * 7/1995 Morita et al. ..... 91/361
5,491,422 A * 2/1996 Bitar et al. ..... 324/636
5,938,847 A * 8/1999 Akimoto et al. ..... 118/665
6,159,291 A * 12/2000 Morita et al. ..... 118/321
6,257,118 B1 * 7/2001 Wilbur et al. ..... 91/361

* cited by examiner

*Primary Examiner*—Yewebdar Tadesse
(74) *Attorney, Agent, or Firm*—Blakely, Sokoloff, Taylor & Zafman LLP

(57) ABSTRACT

According to one aspect of the invention, a fluidic actuator and a control system for the fluidic actuator may be provided. A first component of the actuator may have two openings interconnected by a passageway. A second component may be moveably housed within the passageway and divide the passageway into two portions. A fluid delivery system may be connected to the two openings. The fluid delivery system may supply a first pressure of fluid to the first portion of the passageway causing the second component to move within the passageway at a first speed. When the second component is in a selected position within the passageway, the fluid delivery system may reduce the pressure of the fluid, causing a reduction in speed of the second component. The fluidic actuator may be used in a wafer processing system.

17 Claims, 9 Drawing Sheets

SHOCK ABSORBING FLUIDIC ACTUATOR

BACKGROUND OF THE INVENTION

1). Field of the Invention

This invention relates to a fluidic actuator and more particularly to a fluidic actuator which may be used in a semiconductor substrate processing machine.

2). Discussion of Related Art

Integrated circuits are formed on circular semiconductor wafers. The formation of the integrated circuits includes numerous processing steps such as deposition of various layers, etching particular layers, and multiple bakes.

Often some of these steps take place in large semiconductor wafer processing systems that have countless moving parts and that may move the semiconductor wafers multiple times during the various processing steps. One of the steps involved may be the coating and developing of a photoresist layer on the wafer. These steps take place in what are known as "modules" within the semiconductor wafer processing systems. These modules often include wafer chucks on which the wafers are set and moveable dispense heads that deposit various solutions onto the wafers. Typically the movement, particularly the vertical movement, of the dispense heads is accomplished with one-speed pneumatic actuators.

Because of the large size of some of the components involved, considerable vibration and jolting is experienced by the modules, and the entire system, when the motion of the dispense heads, or any piece of the system that uses the one-speed pneumatic actuators, is ceased. This vibration and jolting leads to a decrease in the longevity, durability, and reliability of the various components of the semiconductor wafer processing systems. Furthermore, the vibration and jolting can cause the various solutions to leak or drip onto the wafers or other components at unwanted times, leading to reduced yields of operable integrated circuits and increased maintenance costs of the wafer processing systems.

SUMMARY OF THE INVENTION

The invention provides a fluidic actuator and a control system for the fluidic actuator. A first component of the actuator may have two openings interconnected by a passageway. A second component may be moveably housed within the passageway and divide the passageway into two portions. A fluid delivery system may be connected to the two openings. The fluid delivery system may supply a first pressure of fluid to the first portion of the passageway causing the second component to move within the passageway at a first speed. When the second component is in a selected position within the passageway, the fluid delivery system may reduce the pressure of the fluid, causing a reduction in speed of the second component. The fluid induced actuator may be used in a semiconductor substrate processing system.

BRIEF DESCRIPTION OF THE DRAWINGS

The invention is described by way of example with reference to the accompanying drawings, wherein.

DETAILED DESCRIPTION OF THE INVENTION

FIG. 1 to FIG. 5 illustrate a fluidic actuator and a control system for the fluidic actuator. A first component may have two openings interconnected by a passageway. A second component may be moveably housed within the passageway and divide the passageway into two portions. A fluid delivery system may be connected to the two openings. The fluid delivery system may supply a first pressure of fluid to the first portion of the passageway causing the second component to move within the passageway at a first speed. When the second component is in a selected position within the passageway, the fluid delivery system may reduce the pressure of the fluid, causing a reduction in speed of the second component. The fluidic actuator may be used in a semiconductor substrate processing system.

Figure 1:
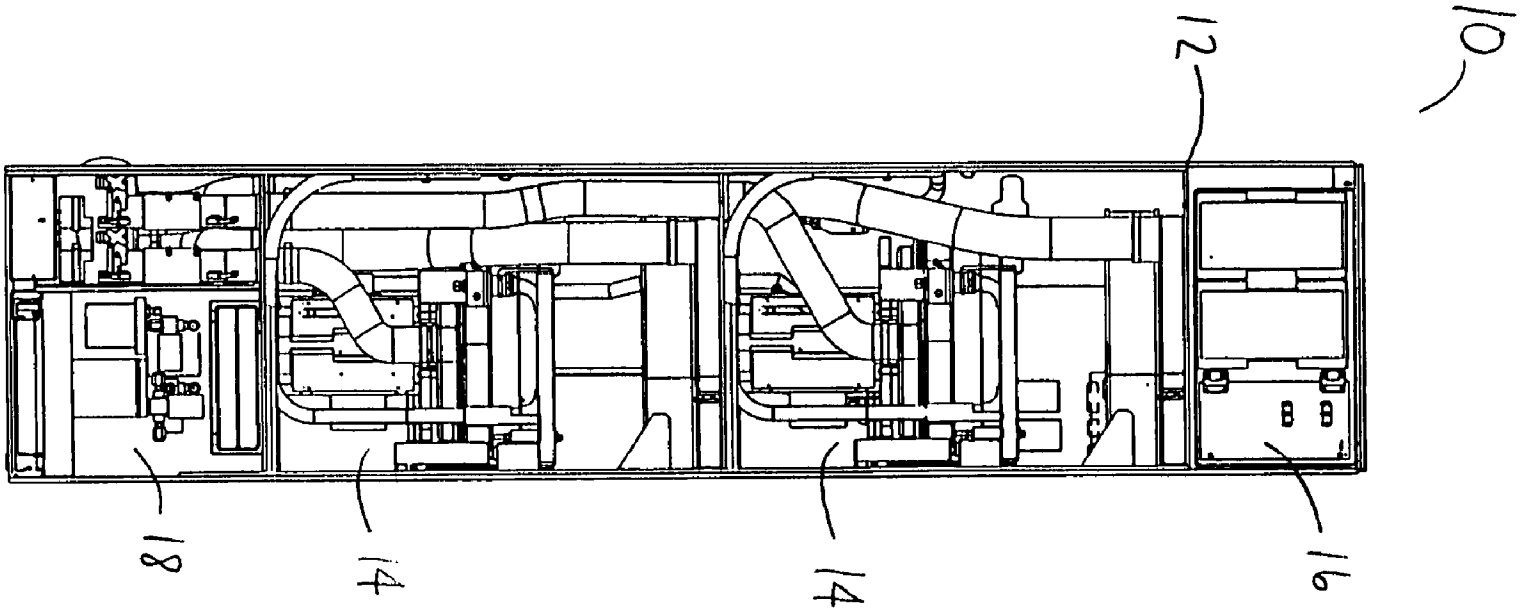
FIG. 1 is a cross-sectional side view of a module stack in a semiconductor substrate processing system, including coater modules, a computer controller, and photoresist pump drawers.

FIG. 1 illustrates a module stack 10 from a semiconductor substrate processing system. In an embodiment, the module stack 10 may include a frame 12, coater modules 14, a computer controller 16, and photoresist pump drawers 18. The photoresist pump drawers 18 may lie at the bottom of the stack 10 and although not shown in detail, may include a photoresist supply and pumps to supply the photoresist to other components of the stack 10, such as the coater modules 14. The coater modules 14 may be vertically stacked above the photoresist pump drawers 18 and may be substantially identical.

The computer controller 16 may lie on top of the coater modules 14 and, although not shown in detail, be electrically connected to the coater modules 14 and the photoresist pump drawers 18, and include a computer with a memory for storing a set of instructions and a processor connected to the memory for executing the instructions, as is commonly understood in the art.

Figure 2:
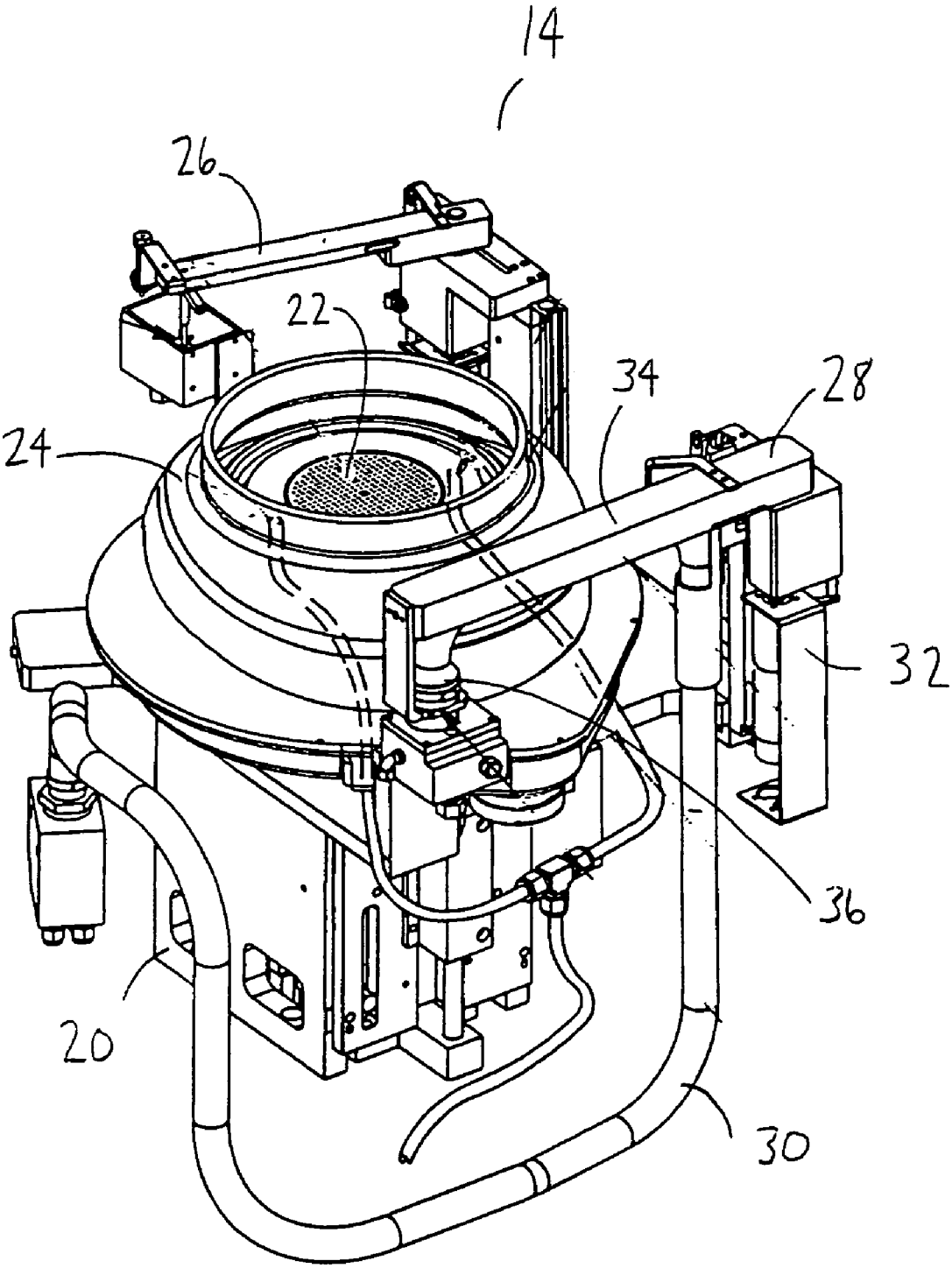
FIG. 2 is a perspective view of one of the coater modules of FIG. 1, including a dispense arm.

FIG. 2 illustrates one of the coater modules 14. The coater module 14 may include a base 20, a wafer chuck 22, a catch cup 24, a Top Edge Bead Removal (TEBR) arm 26, a dispense arm 28, and a photoresist supply line 30.

The base 20 may be attached to the frame 12 of the module stack 10 and be substantially cubic in shape. The wafer chuck, or substrate support, 22 may be on top of the base 20, circular in shape, and connected to the base 20 to rotate about a central axis thereof. The wafer chuck 22 may have an upper surface, which although not shown in detail, is substantially flat and in a plane to support a semiconductor wafer. Although not shown, it should be understood that the base 20 may include an electric motor, or other actuator, to rotate the wafer chuck 22 about the central axis thereof, along with a semiconductor substrate, or wafer, supported by the wafer chuck 22. The catch cup 24 may substantially be an annular, ring-shaped body attached to the top of the base 20, which tapers toward the central axis of the wafer chuck 22 the further the catch cup 24 extends from the base 20. The TEBR arm 26 may be attached to the base 20 so that it may translate transverse to the plane of the wafer chuck 22 and rotate over the wafer chuck 22.

As shown in FIG. 2, the dispense arm 28 may include a vertical piece 32, a horizontal piece 34, and a dispense head 36. The vertical piece 32 may be vertically attached to the base 20, and the horizontal piece 34 may be attached to the vertical piece 32 at a first end thereof so that it may translate transverse to the plane of the wafer chuck 22 and rotate over the wafer chuck 22. The dispense head 36 may be attached to a second end of the horizontal piece 34, and although not shown in detail, include a plurality of nozzles which are directed substantially downwards.

The photoresist supply line 30 may be attached to the dispense head 36 of the dispense arm 28 at one end thereof and, referring back to FIG. 1, attached to the photoresist pump drawers 18 at the other end thereof.

Figure 3:
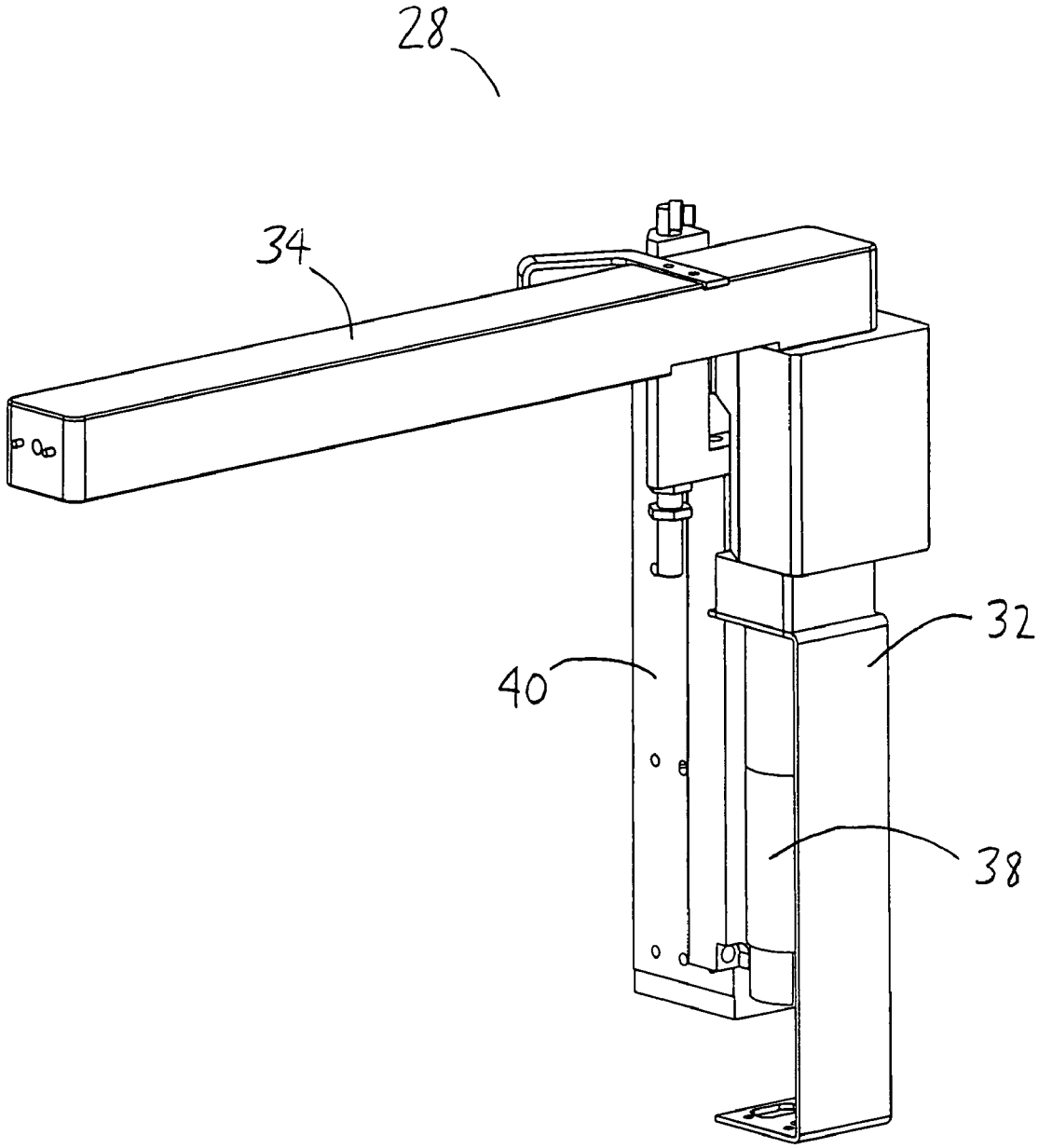
FIG. 3 is a perspective view of the dispense arm, including a fluidic actuator.

FIG. 3 illustrates the vertical piece 32 and the horizontal piece 34 of the dispense arm 28 in an embodiment of the invention. The vertical piece 32 may include a rotational actuator 38 and a Z-motion, or vertical, actuator 40. The rotational actuator 38 may be an electric motor or other such suitable actuator, as is commonly understood in the art, which is connected to the dispense arm 28 to rotate the horizontal piece 34 and dispense head 36 back and forth over the wafer chuck 22.

FIGS. 4*a*-4*e* illustrate the Z-motion actuator 40 and a Z-motion control system 42, which is not shown in FIGS. 1-3. Together, the Z-motion actuator 40 and the Z-motion control system 42 form a fluidic shock absorber apparatus. The Z-motion actuator 40 may be a fluidic or a pneumatic actuator and include a first component, or main body, 44 and a second component 46. Although only shown in cross-section, the first component 44 may be a cylinder with a first opening 48 at a lower end of a sidewall thereof and a second opening 50 at an upper end of the sidewall. The first 48 and second 50 openings may be interconnected by a large passageway 52, having a height 54, within the first component 44. The first component 44 may also include a slot 56 in the sidewall thereof. The first component 44 may be attached to the base 20.

The second component 46 may be slideably connected to the first component 44 through the slot 56 and may include a piston 58 housed within the passageway 52 of the first component 44. The second component 46 may be linearly moveable between a first, lower position and a second, upper position relative to the first component 44, and likewise, the piston 58 may be moveable between a first, lower position and a second, upper position within the passageway 52 of the first component 44. A distance between the first and second positions may be between 50 and 120 millimeters, which may correspond to the height 54 of the passageway 52. The piston 58 may divide and pneumatically seal the passageway 52 into a first portion 60, below the piston 58, and a second portion 62, above the piston 58. The first opening 48 may be adjacent to the first portion 60, and the second opening 50 may be adjacent to the second portion 62. The first component 44 and the second component 46 may be pneumatically sealed so that air may not pass into or out of the passageway 52 through the slot 56. The second component 46 may be attached to the horizontal piece 34 of the dispense arm 28 at an upper end thereof.

The Z-motion control system 42 may include controller hardware 64, a sensor system 66, and a pump 68. The pump 68 may be a pneumatic pump with a high pressure side and low pressure side.

The controller hardware 64 may include a printed circuit board 70, multiple valves 72, and an airflow system 74. The printed circuit board 70 may be connected to the sensor system 66 and may also be connected to the valves 72. The valves 72 may also be connected to the airflow system 74, which is in turn connected to the pump 68. The airflow system 74 may include a series of manifolds and passageways connected to the high-pressure side of the pump 68 to deliver pressurized air, or another fluid, from the pump 68 to the valves 72.

Figure 4A:
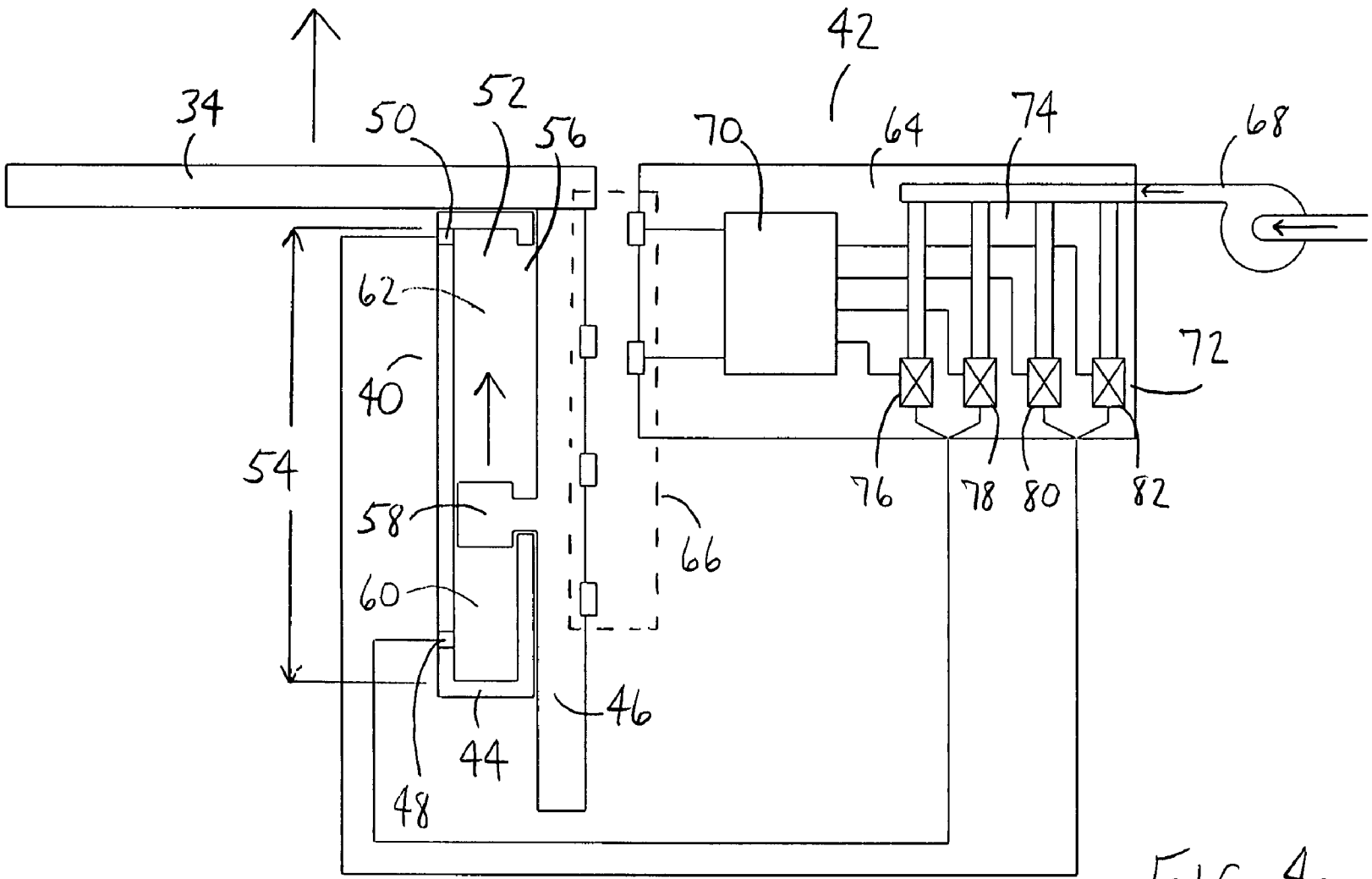
FIGS. 4*a*-4*e* are cross-sectional schematic views of the fluidic actuator and a control system, illustrating operation of the fluidic actuator.

As illustrated in FIG. 4*a*, the valves 72 may include an up high-pressure valve 76, an up low-pressure valve 78, a down high-pressure valve 80, and a down low-pressure valve 82. The up high-pressure valve 76 and the up low-pressure 78 valve may be connected to the first opening 48 of the first component 44, and the down high-pressure valve 80 and the down low-pressure valve 82 may be connected to the second opening 50 on the first component 44 of the Z-motion actuator 40.

Figure 4B:
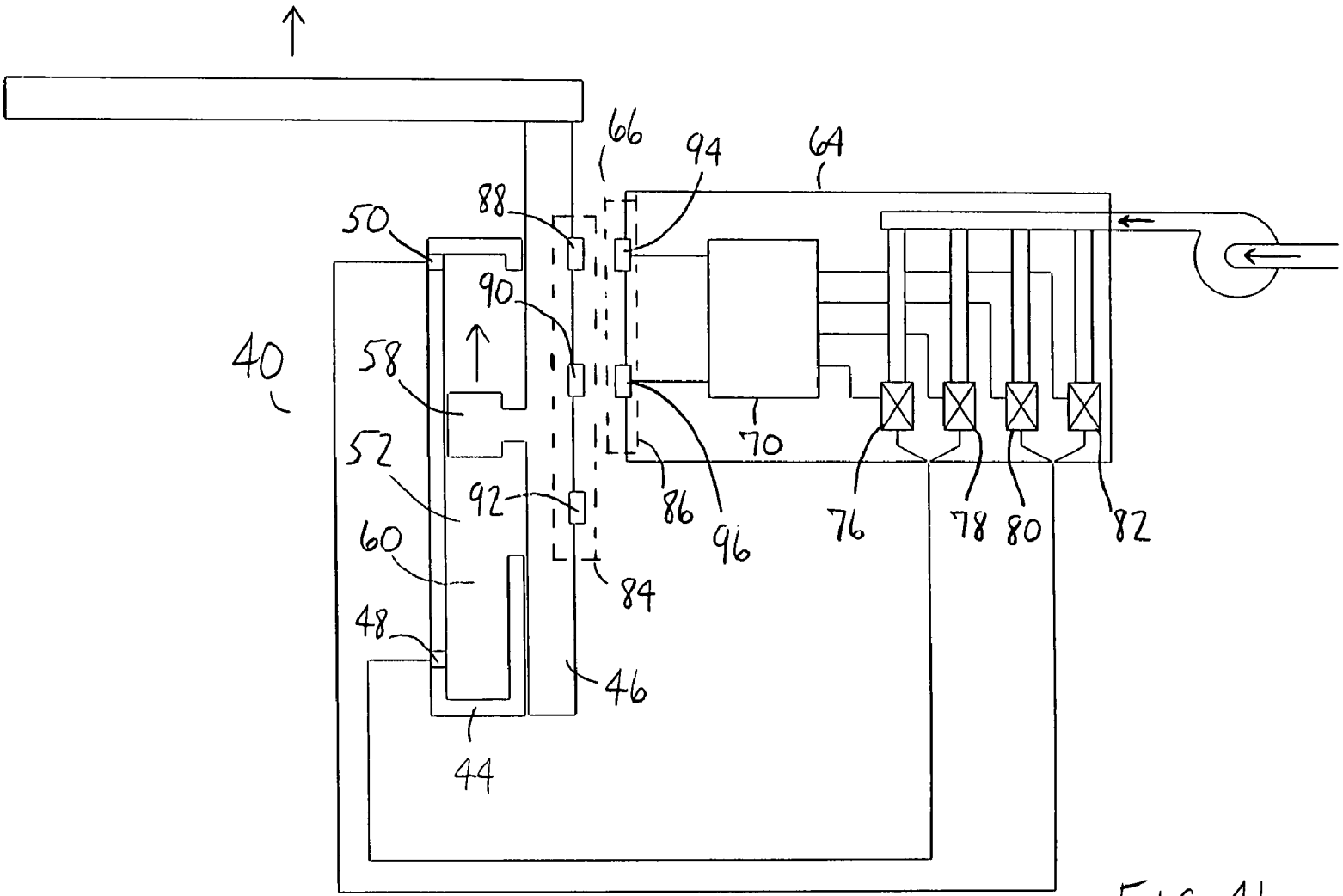

Referring to FIGS. 4*a* and 4*b*, the sensor system 66 may include five sensors separated into a first group 84 and a second group 86. The first group 84 may have three sensors, an up sensor 88, a mid sensor 90, and a down sensor 92, located on the second component 46 of the Z-motion actuator 40. The second group 86 may have two sensors, an up-mid sensor 94 and a down-mid sensor 96, located on the controller hardware 64. The controller hardware 64 may be attached to the frame 12 or base 20 and positioned relative to the Z-motion actuator 40 such that the two groups of sensors face each other. The sensors may be electromagnetic sensors, such as optical sensors. Although not illustrated, the Z-motion control system 42, particularly the printed circuit board 70, may be electrically connected to the computer controller 16.

In use, although not illustrated, a semiconductor substrate, such as a wafer with a diameter of, for example 200 or 300 mm, may be placed on the wafer chuck 22 of the coater module 14. The computer controller 16 may control the Z-motion control system 42 to move the dispense arm 28.

FIG. 4*a* illustrates the second component 46 in the first position. The up high-pressure valve 76 may be opened, releasing a relatively high pressure, such as 85 psi, of air into the first portion 60 of the passageway 52. As indicated by the arrow, the pressure within the first portion 60 may be sufficiently high to exert a first upward force on the piston 58 to lift the piston 58, along with the remainder of the second component 46, which may be connected to the horizontal piece 34 of the dispense arm 28 thereby, as illustrated in FIG. 5, causing translation of the horizontal piece 34 relative to the base 20 and transverse to the plane of the wafer at a first upward speed.

Referring to FIG. 4*b*, when the second component 46 is in a selected position, such as halfway between the first and second positions or when the up-mid sensor 94 detects, or "sees," the up sensor 88 or the down-mid sensor 96 detects the mid sensor 90, the printed circuit board 70 may signal the valves 72 to change the air pressure to the passageway 52. The up high-pressure valve 76 connected to the first opening 48 may close, while at the same time, the up low-pressure valve 78 connected to the first opening 48 may open. The up low-pressure valve 78 may supply a reduced pressure, such as 40 psi, to the first portion 60 of the passageway 52. The relatively low pressure may exert a second, lesser upward force on the piston 58 thereby causing the second component 46 to move at a second, slower upward speed towards the second position. The reduced pressure may, for example, be between 50 and 60 percent of the first pressure.

Figure 4C:
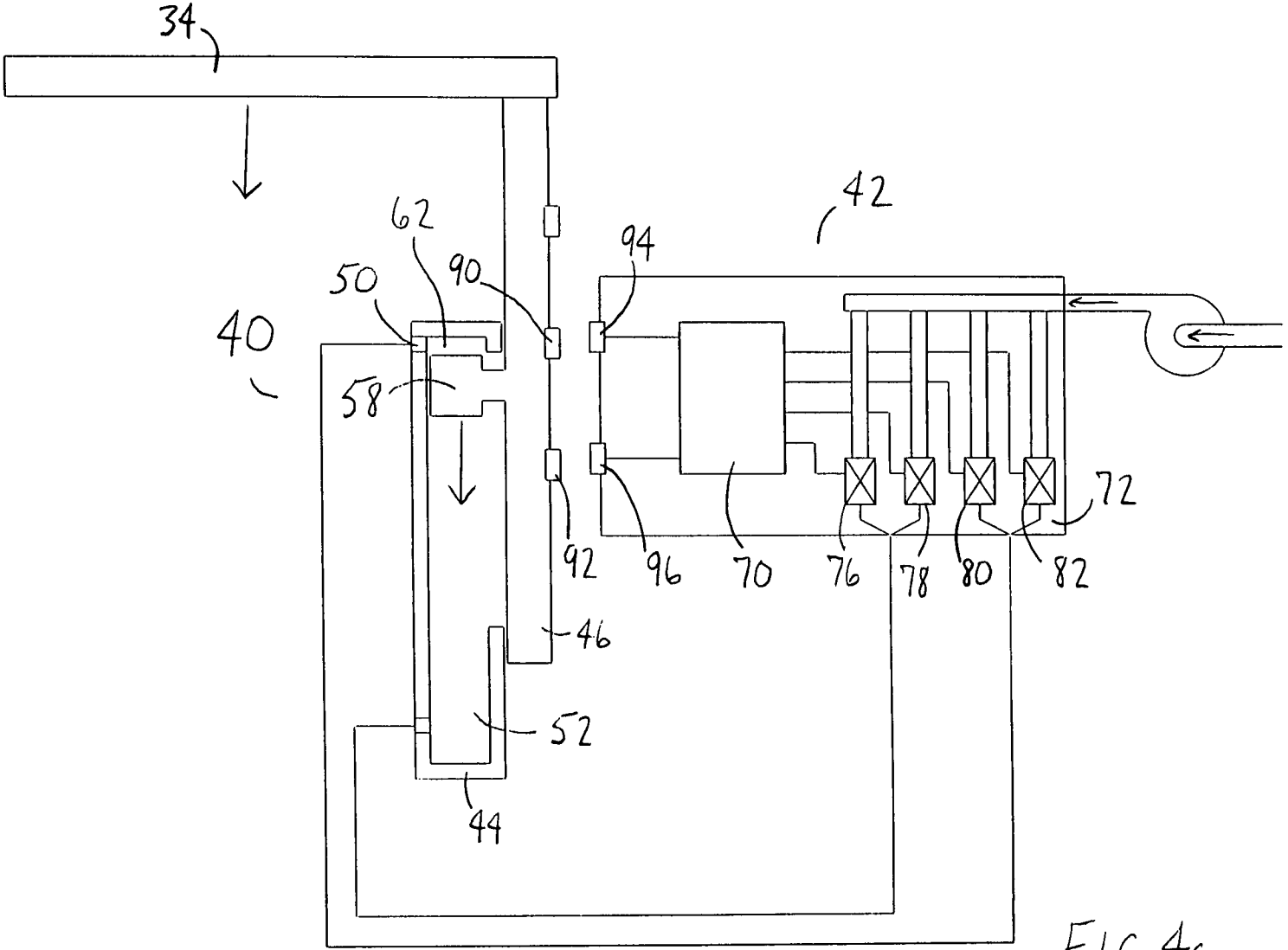

FIG. 4*c* illustrates the piston 58 in the second position within the passageway 52 of the first component 44. When the piston 58 reaches the second position, the second component 46 may be stopped. Because of the reduced speed of the second component 46, the jolting or vibration caused by the stoppage of the second component 46 may be minimized.

Figure 5:
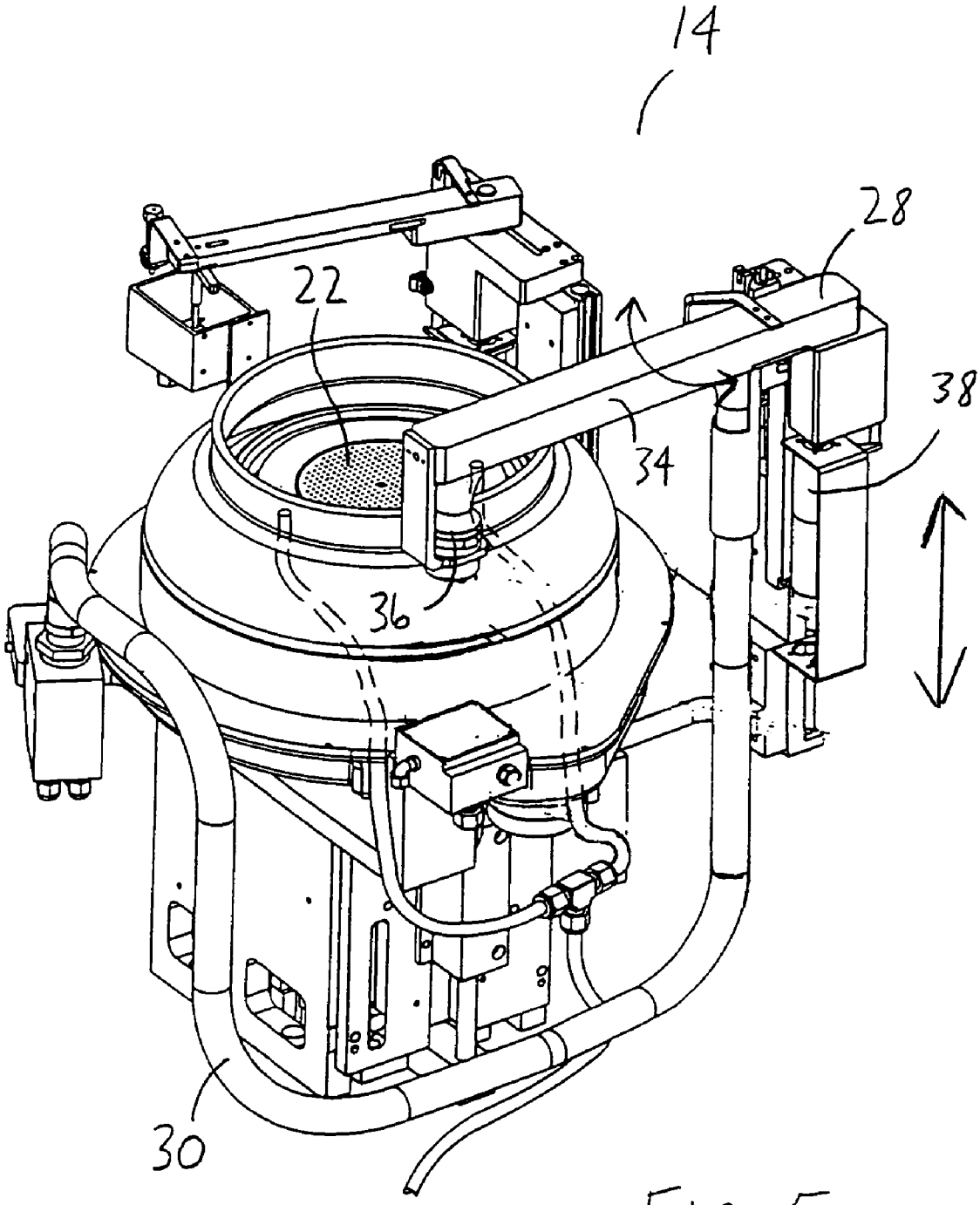
FIG. 5 is a perspective view of the coater module of FIG. 2, illustrating movement of the dispense arm relative to the coater module.

Referring to FIGS. 4*c* and 5, when the second component 46 is in the second position, the horizontal piece 34 of the dispense arm 28 may be rotated by the rotational actuator 38 so that the dispense head 36 is suspended over the semiconductor wafer on the wafer chuck 22. The photoresist pump drawers 18 may then supply photoresist, or other solvent, though the photoresist supply line 30 which is deposited onto the wafer through the nozzles on the dispense head 36. The wafer chuck 22 may spin the wafer while the photoresist is deposited. After the deposition of the photoresist is complete, the horizontal piece 34 of the dispense arm 28 may be again rotated so that the dispense head 36 is no longer over the wafer.

As illustrated in FIG. 4*c*, when the second component 46 is in the second position, either the up-mid sensor 94 may detect the mid sensor 90 or the down-mid sensor may 96 detect the down sensor 92. When either of these occurs, the printed circuit 70 board may signal the valves 72 to switch the air flow to the second opening 50 and reverse the motion of the second component 46.

The computer controller 16, along with the control system 42, may act like a switch and open the down high-pressure valve 80 connected to the second opening 50 of the first component 44 of the Z-motion actuator 40. A relatively high pressure of air, such as 85 psi, may be delivered into the second portion 62 of the passageway 52 of the first component 44 of the Z-motion actuator 40. The relatively high pressure above the piston 58 may exert a first downward force on top of piston 58 causing the piston 58, along with the second component 46, to move downwards at a first downward speed, which may or may not be the same as the first upward speed.

Figure 4D:
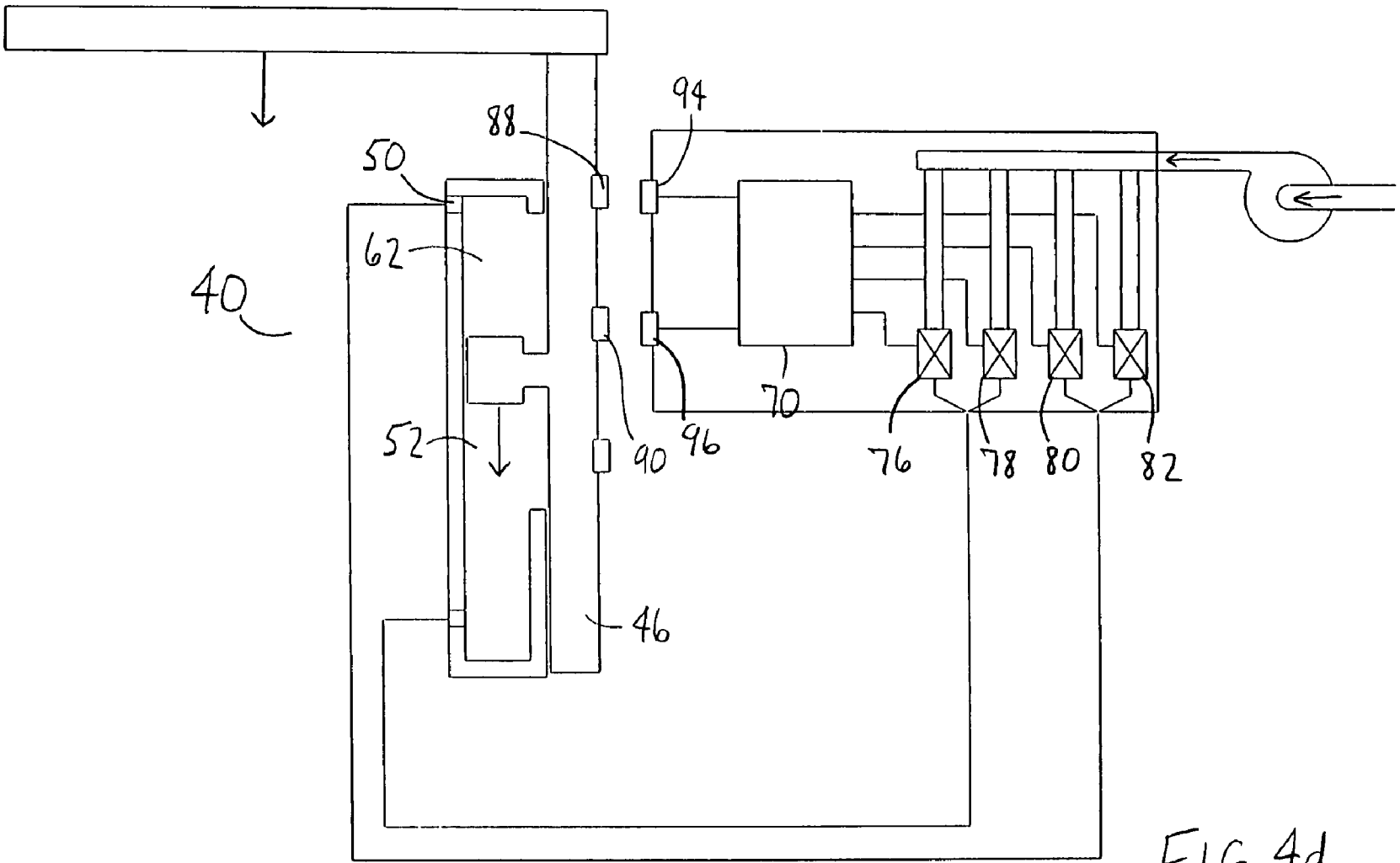

As illustrated in FIG. 4*d*, when the second component 46 is in a downward selected position, which may or may not be the same position as the up selected position and may be detected either by the up-mid sensor 94 detecting the up sensor 88 or the down-mid sensor 96 detecting the mid sensor 90, the printed circuit board 70 may control the valves connected to the second opening 50. The down high-pressure valve 80 connected to the second opening 50 may then be closed, and at the same time, the down low-pressure valve 82 connected to the second opening 50 may be opened. The down low-pressure valve 82 connected to the second opening 50 may release a relatively low pressure, such as 40 psi, into the second portion 62 of the passageway 52. The relatively low pressure may exert a reduced downward force on the piston 58 thereby causing the piston 58, along with the remainder of the second component 46, to move downwards at a reduced speed.

Figure 4E:
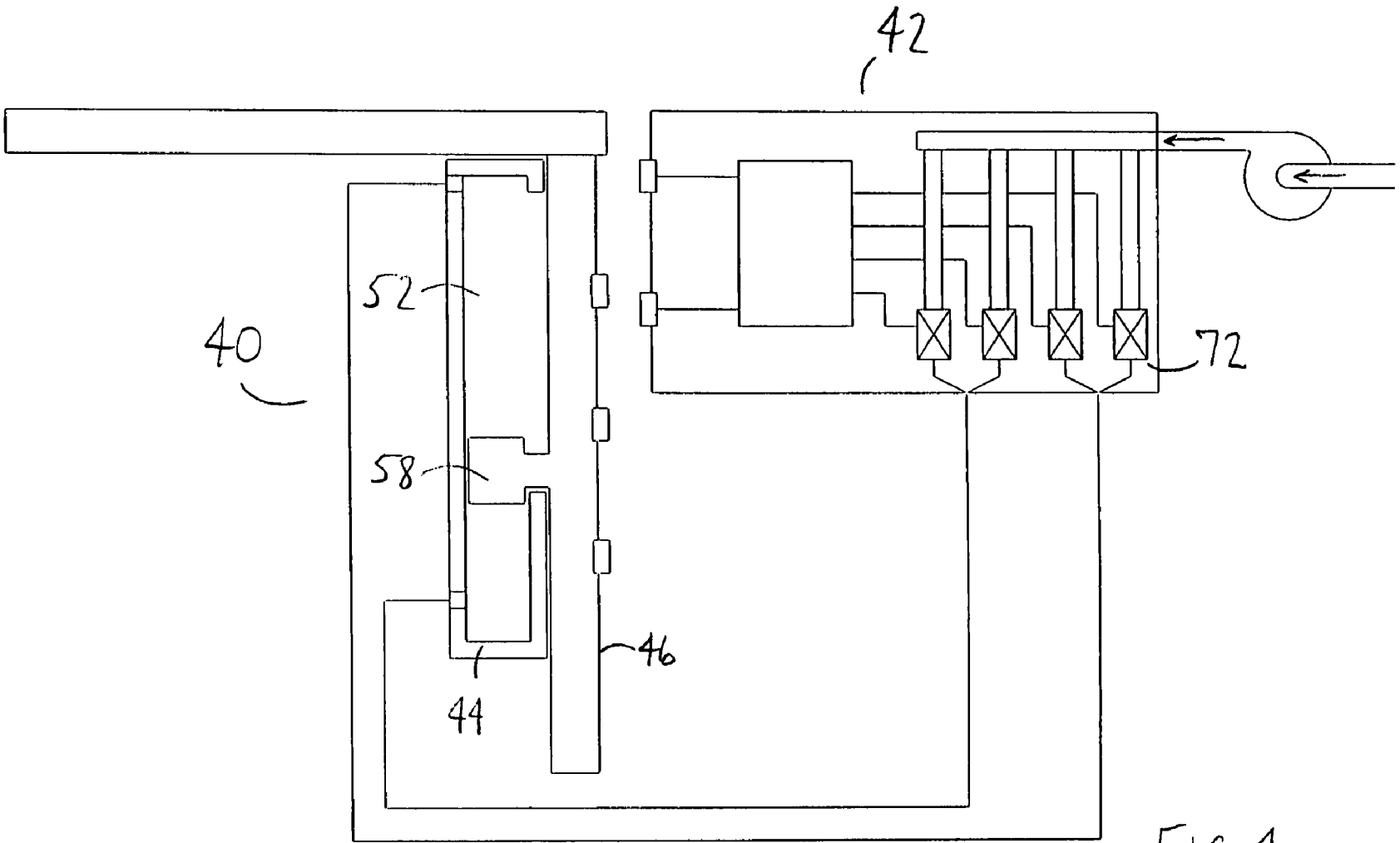

As illustrated in FIG. 4*e*, when the piston 58 returns to the first position in the first component 44 of the Z-motion actuator 40, the downward movement may stop. Because of the reduced speed of the second component 46, any jolting or vibration caused by the stoppage is minimized.

This cycle may be continually repeated as one semiconductor wafer is processed and replaced with another semiconductor wafer.

One advantage is that because the speed of the second component is reduced before stopping, the jolting or vibration experienced by the Z-motion actuator, and the entire system, is reduced. Therefore, the longevity, durability, and reliability of the system are improved. Another advantage is that because the speed of the second component can be varied, the precision of the movement of the actuator is increased and further control over the actuator is gained. A further advantage is that because of the reduced jolting and vibration, any leaking or dripping of the solution deposited by the dispense head is minimized.

Other embodiments may be used in other types of semiconductor wafer processing systems. The fluid induced actuator may also be used in other systems and machines besides those related to wafer processing. Various gases, such as nitrogen, and liquids, such as oil, and other fluids may be used to induce the movement of the actuator besides air. Separate pumps may be connected to each of the openings in the first component. Additional valves may be added to the system so that the speed of the actuator changes more than once while the actuator is being moved between the first and second positions. The pressures supplied to the first and second portions of the passageway may be varied so that a different reduction in speed, and perhaps even an increase in speed, results at some point between the first and second positions.

While certain exemplary embodiments have been described and shown in the accompanying drawings, it is to be understood that such embodiments are merely illustrative and not restrictive of the current invention, and that this invention is not restricted to the specific constructions and arrangements shown and described since modifications may occur to those ordinarily skilled in the art.

What is claimed:

1. An apparatus comprising:

an actuator having a first component with at least one opening and a passageway therein connected to the at least one opening and a second component housed within the passageway being movable between first and second positions within the passageway, the second component dividing the passageway into first and second portions and sealing the first portion from the second portion;

at least one sensor to detect a position of the second component within the passageway; and a pump system having at least one pump and a controller, the at least one pump being connected to the at least one opening supplying a fluid to the first portion of the passageway, the fluid applying a first force onto the second component, moving the second component between the first and second positions at a first speed, the controller being connected to the at least one pump and the at least one sensor, the controller controlling the at least one pump to change the supply of fluid to the first portion of the passageway to apply a second force onto the second component, moving the second component between the first and second positions at a second speed, wherein the first component of the actuator has first and second openings, the passageway interconnects the first and second openings, and wherein the at least one pump is connected to the first and second openings and further comprising a switch interconnecting the at least one pump and the first component, the controller being connected to the switch, and wherein the controller controls the switch to change the supply of fluid between the first opening and the second opening when the piston is in the second position.

2. The apparatus of claim 1, wherein the first force is greater than the second force.

3. The apparatus of claim 2, wherein the first speed is greater than the second speed.

4. The apparatus of claim 3, the first opening is adjacent to the first portion of the passageway, and the second opening is adjacent to the second portion of the passageway.

5. The apparatus of claim 4, wherein the first component of the actuator is a cylinder and the second component of the actuator is a piston within the cylinder.

6. The apparatus of claim 5, wherein said movement of the piston between the first and second positions of the passageway within the cylinder is substantially linear.

7. The apparatus of claim 6, wherein there are a plurality of sensors.

8. The apparatus of claim 7, wherein the sensors are electromagnetic.

9. The apparatus of claim 7, wherein the sensors are optical.

10. The apparatus of claim 9, wherein the fluid is air.

11. The apparatus of claim 1, further comprising first and second pumps, the first pump being connected to the first opening and the second pump being connected to the second opening, the controller being connected to the first and second pumps.

12. The apparatus of claim 11, wherein the controller controls the first and second pumps to change the supply of fluid between the first opening and the second opening when the piston is in the second position.

13. A semiconductor substrate processing apparatus comprising:

a frame;

a substrate support mounted to the frame to support a semiconductor substrate;

a dispense arm mounted to the frame for movement relative to the substrate support;

a dispense arm actuator having a first component with at least one opening and a passageway therein connected to the at least one opening and a second component housed within the passageway being movable between first and second positions within the passageway, the second component dividing the passageway into first and second portions and sealing the first portion from the second portion, at least one of the components being connected to the frame and at least one of the components being connected to the dispense arm;

at least one sensor coupled to the dispenser arm actuator to detect a position of the second component within the passageway; and a pump system having a pump and a controller, the pump being connected to the at least one opening and supplying a fluid to the first portion of the passageway, the fluid applying a first force onto the second component to move the second component between the first and second positions at a first speed, the controller being connected to the pump and the at least one sensor, the controller controlling the pump to change the supply of fluid to the first portion of the passageway, when the second component is in a selected position within the passageway, to apply a second force onto the second component to move the second component between the first and second positions at a second speed, the second component stopping in the second position in the passageway, wherein the first component of the dispense arm actuator has first and second openings, the passageway interconnects the first and second openings, and wherein the pump is connected to the first and second openings and further comprising a switch interconnecting the pump and the first component, the controller being connected to the switch, and wherein the controller controls the switch to change the supply of fluid between the first opening and the second opening when the piston is in the second position.

14. The semiconductor substrate processing apparatus of claim 13, wherein the first force is greater than the second force.

15. The semiconductor substrate processing apparatus of claim 14, wherein the first speed is greater than the second speed.

16. The semiconductor substrate processing apparatus of claim 15, the first opening is adjacent to the first portion of the passageway, and the second opening is adjacent to the second portion of the passageway.

17. The semiconductor substrate processing apparatus of claim 16, wherein the wafer support has a surface in a plane and the dispense arm is mounted to the frame for translating in a direction transverse to the plane.

* * * * *